United States Patent [19]

Balistrieri

[11] 3,964,718

[45] June 22, 1976

[54] APPARATUS FOR CRUSHING MATERIAL

[76] Inventor: Peter A. Balistrieri, 1412 S. Park Ave., Buffalo, N.Y. 14220

[22] Filed: Sept. 6, 1974

[21] Appl. No.: 503,711

[52] U.S. Cl. ..... 241/79; 241/159; 241/234; 241/235

[51] Int. Cl.[2] ..... B02C 4/32

[58] Field of Search ..... 241/79, 157, 159, 230, 241/234, 235, 236

[56] References Cited

UNITED STATES PATENTS

| | | | |
|---|---|---|---|
| 2,733,866 | 2/1956 | Bernard | 241/159 |
| 2,996,261 | 8/1961 | Picalarga | 241/79 X |
| 3,353,947 | 11/1967 | Kramer | 241/79 X |

FOREIGN PATENTS OR APPLICATIONS

| | | | |
|---|---|---|---|
| 650,462 | 5/1936 | Germany | 241/159 |

*Primary Examiner*—Roy Lake
*Assistant Examiner*—E. F. Desmond
*Attorney, Agent, or Firm*—Sommer & Sommer

[57] ABSTRACT

A crusher includes a housing having an internal conduit for directing the advance of material therethrough. A plurality of cooperative pairs of rotatable crush rollers are disposed within the conduit. An endless flexible chain is operatively arranged to rotate each crush roller in a direction to cause material to be advanced through the crusher. Material to be crushed enters the conduit through an inlet and is progressively crushed between the rollers of each successively encountered pair. Crushed material is separated by size and discharged from the crusher via an outlet chute. The spacing between the bottom cooperative pair of crush rollers may be adjusted by selective rotation of a cam member.

7 Claims, 8 Drawing Figures

APPARATUS FOR CRUSHING MATERIAL

BACKGROUND OF THE INVENTION

1. Field of the Invention

The present invention relates generally to apparatus for crushing material, such as coal, coke, oil shale, fruits and vegetables, and the like.

2. Description of the Prior Art

Undoubtably, it is known to crush material by passing the same between spaced jaw portions of a single pair of cooperative crush roller members.

However, the amount of size reduction between material admitted to the crusher and the crushed material may influence several design parameters of the crusher apparatus. For example, such parameters might typically include the size and strength of the housing, the size and strength of the crush rollers, and the power requirement.

SUMMARY OF THE INVENTION

The present invention relates to apparatus for crushing material, such as coal, coke, oil shale, fruits and vegetables, and the like.

The inventive crusher broadly includes a housing having a conduit for directing an advance material therethrough; a plurality of cooperative pairs of rotatable crush rollers suitably journalled on the housing and arranged within the conduit, the rollers of each cooperative pair being operatively spaced from one another and adapted to crush material passing therebetween; and drive means operatively arranged to rotate at least one roller of each pair in a direction to cause material passing between the rollers of each of the pairs to be advanced toward an outlet. Material to be crushed may be admitted to the conduit by an inlet. Coarse crushed material is discharged via a first outlet and finer particles, or in some cases liquids, may be discharged via a second outlet.

In the preferred embodiment, the rollers of a pair arranged closer to the outlet is less than the spacing between the rollers of another pair arranged further from the outlet. Hence, material is progressively and gradually crushed between the cooperative pairs of rollers as it is advanced from the inlet to the outlet.

The inventive crusher may further include guide means mounted on the housing and arranged within the conduit for guiding or directing material crushed between one of said pairs downwardly to the space between the rollers of the next successive pair.

The drive means may include endless flexible means, such as a flexible chain, and motor means arranged to move the flexible means. The endless flexible chain may engage the rollers of each cooperative pair for rotating each roller in a direction to cause material to be advanced downwardly through the crusher toward the outlet.

In a preferred embodiment, the crusher may further include adjustment means operatively arranged between the housing and at least one of the rollers for adjusting or varying the spacing between the cooperative pair including the adjustably-mounted roller. The adjustment means may include a cam member movably mounted on the housing, and a holding member arranged to engage the cam member for holding the cam member immovable at a selected location or position. In one form, the cam member may be a circular disc movably mounted on the housing and arranged to receive and journal the adjustable roller at an eccentric location on the disc. Hence, by rotating the cam member, the eccentrically-mounted roller may be moved closer to or away from the other roller of its cooperative pair. Alternatively, both rollers of a single cooperative pair may be provided with the adjustment means.

The inventive crusher may be further provided with separating means arranged to receive crushed material and to discharge one component part thereof through one outlet and a second component part thereof through a second outlet. In one form, the separating means includes a filter screen permeable to constituents of one size but impermeable to constituents of a second size.

Accordingly, one object of the present invention is to provide apparatus for crushing material.

Another object is to provide improved crusher apparatus wherein material is progressively crushed between successively encountered cooperative pairs of rotatable crush rollers.

Another object is to provide improved crusher apparatus wherein the spacing between a cooperative pair of crush rollers is adjustable.

Still another object is to provide improved crusher apparatus having means for separating by size one coarse component of crushed material from another more finely divided solid or liquid component thereof.

These and other objects and advantages will become apparent from the foregoing and ongoing specification which includes the drawings and appended claims.

DESCRIPTION OF THE PREFERRED EMBODIMENT

Figure 1:
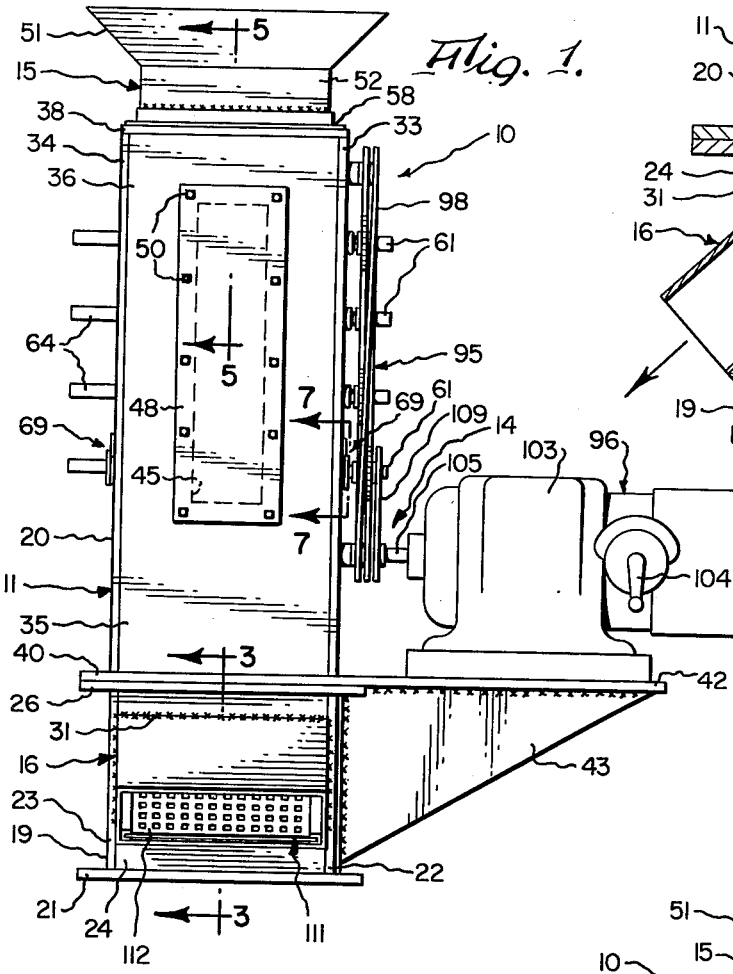
FIG. 1 is a left side elevational view of the inventive crusher, such view illustrating the housing, the inlet, the left outlet, and the drive means.

At the outset, it should be clearly understood that like reference numerals are intended to identify the same elements and/or structure throughout the several drawing figures, as such elements and/or structure may be further described or explained by the entire written specification of which this detailed description is an integral part.

Figure 3:
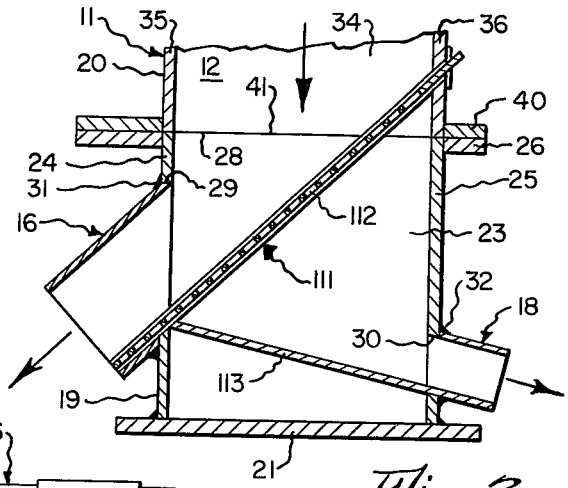
FIG. 3 is an enlarged fragmentary vertical sectional view thereof, taken centrally on line 3—3 of FIG. 1, and particularly showing the lower housing part, the left and right outlet chutes, and the inclined separation screen arranged therebetween.
Figure 2:
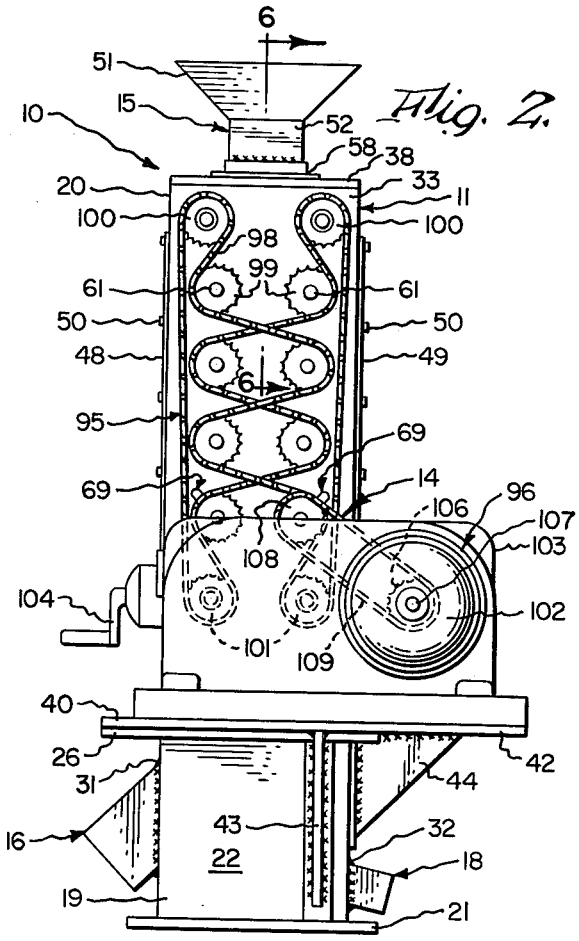
FIG. 2 is a front elevational view of the crusher depicted in FIG. 1 particularly showing the housing, the inlet, the left and right outlets, and the flexible means.

Referring initially to FIGS. 1, 2, 5 and 6, conjunctively, the inventive crusher apparatus, generally indicated at 10, broadly includes an upstanding rectangular tubular housing 11 having a vertically-elongated internal conduit 12 (FIGS. 5 and 6), a plurality of crush rollers 13 (FIGS. 5 and 6) disposed within the conduit and arranged in four vertically-spaced tiers of horizontally-opposite cooperative spaced pairs, and drive means 14 operatively arranged to rotate each of the rollers. Material to be crushed may be admitted to crusher 10 through an upper inlet 15, and be thereafter advanced downwardly through the vertical housing conduit 12, wherein it is successively passed between the cooperative rollers 13 of each vertical tier, and subsequently discharged through left and right lower outlet or discharge chutes 16, 18 (FIGS. 2 and 3).

As used herein, the term "material" is intended in its broadest sense to include any material which is desired to be crushed and specifically includes, but is not limited to, various types of fruits and vegetables, fertilizers, oil shale, coke, coal, and the like.

In the presently preferred embodiment herein described, housing 11 is shown as being a vertically-elongated two-piece rectangular tube having a lower tubular part 19 and an upper tubular part 20. The housing lower part 19 includes a rectangular horizontal bottom plate 21 arranged to rest on a suitable support or foundation (not shown); opposite rectangular vertical front and rear lower panels 22, 23 extending upwardly from plate 21; and a horizontal perimetrical upper flange 26 extending outwardly from the housing lower part about its horizontal rectangular open upper end 28. The left and right side panels 24, 25 are shown further provided with horizontally-elongated rectangular upper and lower discharge or outlet openings 29, 30 respectively, therethrough. As best shown in FIG. 3, left discharge chute 16 is a downwardly and outwardly (leftwardly as viewed in FIG. 3) inclined open-ended rectangular tube having a marginal portion about its open upper end suitably attached to lower left side panel 24 about opening 29 by a peripheral weldment 31. Similarly, right discharge chute 18 is a downwardly and outwardly (rightwardly as viewed in FIG. 3) inclined open-ended rectangular tube having a marginal portion about its open upper end suitably attached to lower right side panel 25 by peripheral weldment 32. Alternatively, and in lieu of weldments 31, 32, these discharge chutes may be removably secured to the lower housing part by suitable bolt-type fasteners (not shown). These discharge chutes 16, 18 are operatively arranged to receive material crushed by rollers 13 and to direct the discharge of such crushed material passing through openings 29, 30 away from the crusher.

The housing upper part 20 is shown as including an internal conduit 27 bounded by opposite vertically-elongated rectangular vertical front and rear upper panels 33, 34; opposite vertically-elongated rectangular vertical left and right upper side panels, 35, 36, suitably joined to the front and rear upper panels; and a rectangular horizontal top plate 38 suitably secured to the uppermost marginal portions of each of the upper panels and having a central rectangular opening 39 therethrough. As best shown in FIGS. 1 and 2, the housing upper part 20 further includes a lower horizontal perimetrical flange 40 extending outwardly from panels 33, 34, 35, 36 about its horizontal rectangular open lower end or outlet opening 41. This perimetrical flange 40 includes an integral large area rectangular portion 42 extending outwardly from front panel 33 and forming a horizontal front table for supporting a portion of the drive means, later described.

The housing upper part 20, is arranged to have the lower surface of flange 40 abut the upper surface of flange 26. Thereafter these flanges 40, 26 of the upper and lower housing parts may be suitably secured together by a plurality of fasteners (not shown) or by a weldment (not shown). In the preferred embodiment, the large area table portion 42 of flange 40 is additionally braced by triangular vertical plates 43, 44 arranged to have their vertical edges suitably secured, as by welding, to the lower front and right side panels 22, 25, respectively, and their horizontal upper edges suitably secured to the horizontal planar lower surface of table portion 42. The left and right upper side panels 35, 36 are shown further provided with central vertically-elongated rectangular access openings 45, 46, respectively, which are arranged to be closed by left and right cover plates 48, 49 removably secured to the corresponding upper side panel by a plurality of mutually spaced bolt fasteners 50.

Figure 5:
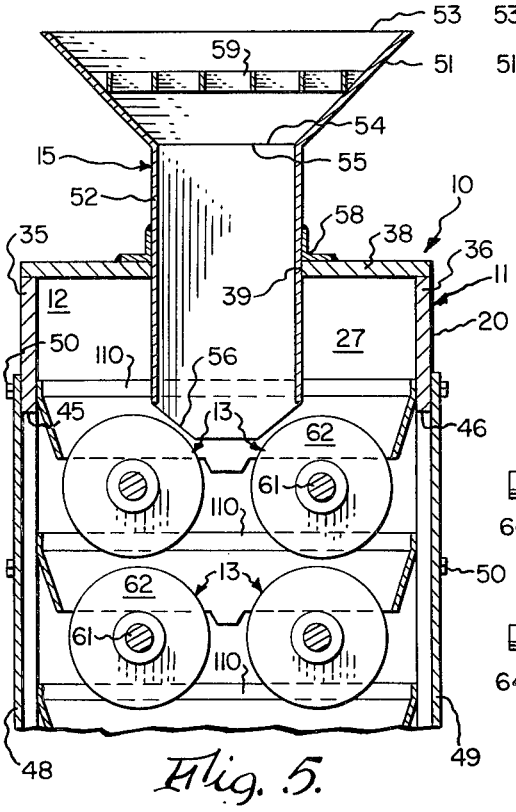
FIG. 5 is an enlarged fragmentary vertical sectional view of an upper portion of the crusher, such view taken centrally on line 5—5 of FIG. 1 and illustrating in cross-section, the inlet, the two uppermost tiers of cooperative pairs of crush rollers, and the guide hoppers, and the spacing of the roller sprockets from the housing front panel.
Figure 6:
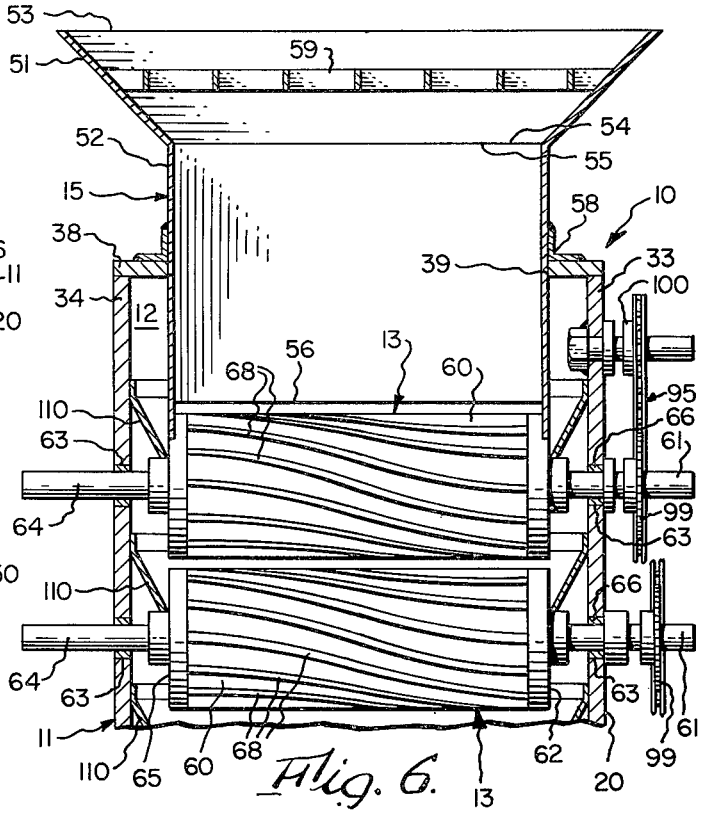
FIG. 6 is an enlarged verticle sectional view taken along lines 6—6 of FIG. 2.

Referring now to FIGS. 5 and 6, the inlet 15 is shown as being a rectangular funnel-shaped member having an upper hopper portion 51, and a lower chute portion 52 arranged in top opening 39. The hopper portion 51 has four rectangularly-arranged downwardly and inwardly inclined trapezoidal hopper side panels which are severally arranged to have their non-parallel edge portions suitably secured to a non-parallel edge portion of each adjacent hopper side panel, thereby providing the hopper portion 51 with a large area rectangular horizontal open upper end 53 and a smaller area rectangular horizontal open lower end 54. The chute portion 52 is shown as being an vertical open-ended rectangular tube having an uppermost marginal portion about its open upper end 55 suitably secured to a lower marginal portion of the hopper portion about its lower end 54 such that chute upper end 55 communicates with the open lower end 54 of the hopper portion, and having its open lower end 56 arranged within housing conduit 12. An intermediate part of chute portion 52 is passed through top opening 39 and is secured in this position by four peripherally-arranged angle sections 58 suitably welded to the chute portion 52 and to top 38. If desired, a horizontal rectangular screen or grid 59 may be arranged within the inlet hopper portion 51 and suitably secured to the hopper side panels to prevent oversized pieces of material from entering the crusher. Thus, material to be crushed may be admitted to the conduit by downward passage through the hopper portion 51 and the chute portion 52 of the inlet 15.

In the presently preferred embodiment herein disclosed, the inventive crusher apparatus 10 includes eight crush rollers 13 arranged in four vertically-spaced tiers of horizontally-spaced cooperative pairs. As best shown in FIGS. 5 and 6, each crush roller 13 of the three upper-most tiers includes a horizontally-elongated cylindrical roller portion 60 disposed within housing conduit 12 and mounted fast to a horizontal axial shaft having a forward portion 61 extending outwardly (rightwardly in FIG. 6) from the vertical annular front end face 62 of the roller portion through a hole 63 provided in the housing front panel 33, and having a rearward portion 64 extending outwardly (leftwardly in FIG. 6) from the vertical annular rear end face 65 of the roller portion through an alinged hole 63 provided in housing rear panel 34. The crush rollers 13 of the top and two intermediate tiers are shown suitably journalled on the housing by bearings 66 suitably arranged in holes 63 and secured to the housing. As best illustrated in FIG. 6, each of roller portions 60 is provided with a plurality of radially-upstanding circumferentially-spaced helically-wound hardened jaws or teeth 68 adapted to crush material passing between a cooperative pair of crush rollers. In the preferred embodiment, the crush rollers of any cooperative pair arranged closer to the outlet 41 are spaced more closely than any other cooperative pair arranged further from the outlet to progressively crush material advancing the length of conduit 12 toward the outlet. In other words, the horizontal spacing between the rollers of the top pair is greater than such spacing between the rollers of next adjacent lower pair, which in turn is greater than the spacing between the rollers of next adjacent lower pair, which in turn is greater than the spacing between the rollers of the next lower adjacent pair. While the preferred embodiment herein illustrated is shown as having eight crush rollers arranged in four vertical tiers of cooperative horizontal pairs, it should be clearly understood that the present invention contemplates that a greater or lesser number of such cooperative pairs may be used to accomodate particular service conditions. Similarly, while it is presently preferred to employ the teeth 68 of the shape herein described, the present invention further contemplates that other shapes and configurations of such teeth may be utilized to provide the equivalent function.

Figure 7:
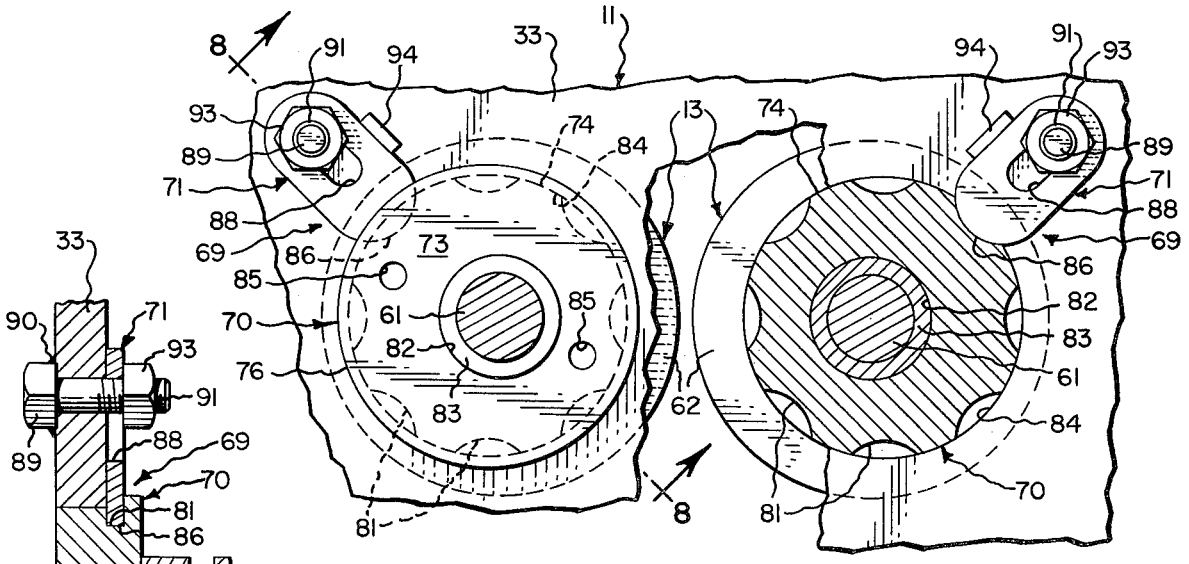
FIG. 7 is a greatly enlarged fragmentary vertical sectional view, taken generally on line 7—7 of FIG. 1, illustrating one cam member in front elevation and another in cross-section, and particularly showing the roller shafts eccentrically journalled therein and each holding member operatively engaged in a selected cam recess to hold the cam member immovable at this angular position.
Figure 8:
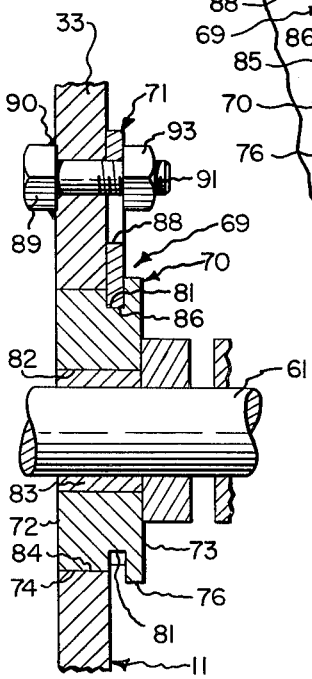
FIG. 8 is a fragmentary sectional view taken centrally through the one of the cam and holding members on line 8—8 of FIG. 7, showing such one of the cam and holding members in cross-section.

Referring now to FIGS. 7 and 8, crusher 10 further includes adjustment means, generally indicated at 69, operatively associated with the housing and with the forward and rearward shaft portions 61, 64 of each of the crush rollers 13 of the bottom cooperative pair for selectively varying or adjusting the spacing between such lower rollers, this being representatively shown for shaft 61 in FIG. 8. Each of the adjustment means 69 includes a rotatable cam member 70, and a holding member 71 operatively arranged to engage and hold the cam member immovable at a selected angular position or location. Each of cam members 70 is shown as being a horizontally-thickened vertical circular disc-like member having inner (leftward in FIG. 8) and outer (rightward in FIG. 8) annular vertical end faces 72, 73; and a circumferential surface having a leftward inner cylindrical surface portion 74 extending outwardly (rightwardly) from inner face 72, and a rightward outer larger diameter cylindrical surface portion 76 continuing outwardly (rightwardly) to outer end face 73. The inner cylindrical surface portion 74 is provided with a plurality of circumferentially-spaced radially-extending concave recesses 81 extending into the cam member. Each cam member 70 further includes an eccentrically-positioned horizontal through-bore 82 suitably provided with a roller bearing 83, similar to the bearings 66 previously described. Each cam member 70 is rotatably mounted on the housing to have circumferential surface portion 74 face the cylindrical surface 84 of a horizontal hole provided through the front or rear upper housing panels, and is additionally provided with a pair of diagonally-spaced horizontal holes or recesses 85 extending into the cam member from its outer face 73, which recesses 85 are arranged to receive the pins of a spanner wrench (not shown) by which the cam member may be rotated to any selected one of a plurality of angular positions. The shaft end portions 61, 64 of the bottom pair of rollers are suitably journalled in the eccentrically-positioned bearings 83, as depicted for shaft 61 in FIG. 8. Hence, by rotating one of the cam members, the adjustable crush roller 13 of the bottom cooperative pair may be moved toward or away from the other roller of its pair to adjust or vary the spacing therebetween.

Each holding member 71 is shown configured as an elongated plate-like member arranged on the outer side of the front panel 33, having a rounded lower end 86 arranged to be received in any of recesses 81, and further provided with central elongated slot 88. A bolt 89 has its rear portion suitably fixed, as by peripheral weldment 90, to the inner surface (leftward in FIG. 8) of housing front panel 33, and has its horizontal threaded portion 91 passed through slot 88 to receive a nut 93. It should be readily apparent to those skilled in this art that when nut 93 is loosened, holding member 71 may be moved out of engagement with any one of cam recesses 81 to permit the cam member to be rotated to a new selected angular position. Thereafter, holding member 72 may be moved to re-engage its operative lower end 86 with the selected recess 81, and nut 93 may thereafter be suitably tightened to hold the cam and locking members immovable at the selected angular location. The outer surface of the front panel 33 is shown further provided with an outwardly extending boss or lug 94 to prevent rotation of the holding member when the crusher is operated.

Figure 4:
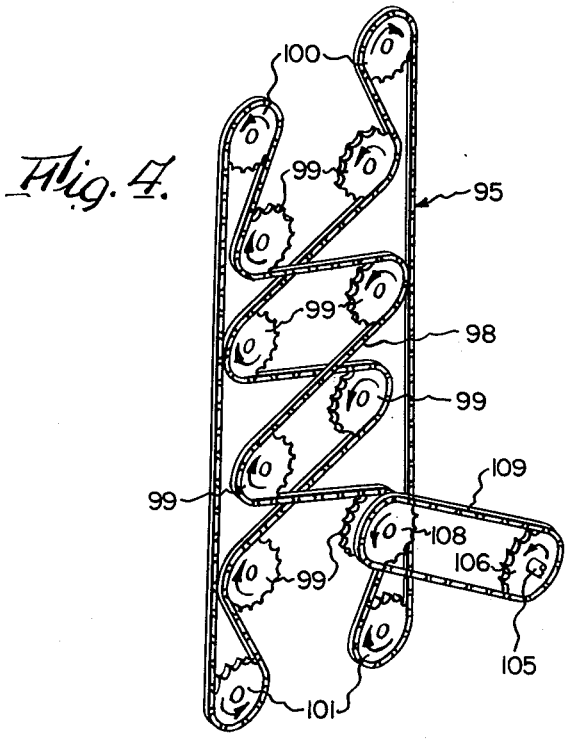
FIG. 4 is an enlarged perspective schematic view of the endless flexible chain illustrated in FIG. 2, showing its engagement with the roller sprockets and the idler sprockets, indicating the direction of rotation of each sprocket when the chain is moved, and further showing the manner by which the drive means may move the endless flexible chain to rotate each of the crush rollers.

The drive means 14 broadly includes flexible means, generally indicated at 95, operatively engaging each of crush rollers 13, and motor means 96 arranged to move the flexible means for rotating the crush rollers. As best shown in FIG. 4, the flexible means 95 is an endless flexible chain 98 suitably engaging each of sprockets 99 mounted on the forward shaft portions 61, and further engaging a pair of freely rotatable upper idler sprockets 100 and a pair of freely rotatable lower idler sprockets 101, to rotate each of crush rollers 13 in a direction to cause material to be advanced through the crusher. As best seen in FIG. 4, the flexible chain 98 is arranged to rotate the vertical column of left shafts 61 in a clockwise direction, and to rotate the vertical column of right shafts 61 in a counter-clockwise direction, these directions being indicated by the arrows in FIG. 4. Accordingly, the crush rollers 13 of each cooperative pair will be rotated in opposite angular directions, thereby tending to advance material passing therebetween downwardly toward the lower outlet. It will be further appreciated by those skilled in this art that some of roller sprockets 99 and some of idler sprockets 100, 101 will have to be spaced further from the housing upper front panel 33, as may be viewed in FIGS. 2, 4, and 6, to prevent the chain from binding upon itself.

The motor means 96 may include an electric motor 102 operatively connected to a variable speed drive unit 103 mounted on table portion 42, the output of unit 103 being adjustable via speed control lever 104. Variable speed drive unit 103 is capable of rotating its output shaft 105 at a speed adjustably proportional to the rotational speed of the motor shaft 107 (FIG. 2). A driving sprocket 106, mounted fast on output shaft 105, is operatively connected to a driven sprocket 108, mounted fast to the right shaft 61 of the lower pair, by an endless flexible chain 109. Hence, the motor means 96 is operable to move flexible chain 98 for rotating each of crush rollers 13 in the directions previously indicated.

Referring again to FIGS. 5 and 6, the crusher 10 preferably includes four vertically-spaced downwardly and inwardly inclined guide means, generally indicated at 110, severally arranged within the conduit 12 and secured to the housing upper part 20 to direct the advance of material crushed by one pair of rollers down to the lower adjacent pair. In this fashion, the hopper-like guide means 110, functions as a trough or funnel and serves to insure that material will be progressively passed between each cooperative pair of crush rollers 13.

Referring again to FIG. 3, crusher 10 is shown as further including separation means, generally indicated at 111, operatively positioned in the lower housing part 19 to separate one component of the crushed material from another component thereof. The separation means 111 is shown as including downwardly and leftwardly inclined filter screen 112 arranged within the housing lower part 19 to receive and separate material crushed by rollers 13. It will be appreciated that screen 112 is permeable to liquids and small finely-divided solid particles of such crushed material, but is impermeable to larger particles. It is further contemplated that screen 112 may be agitated or vibrated, either electrically or pneumatically (not shown), to insure a high degree of separation of such permeable and non-permeable constituents. Specifically, large pieces of impermeable crushed material will fall on screen 112 and be deflected leftwardly through left discharge chute 16. On the other hand, small pieces of permeable crushed material, or liquids, may pass through screen 112 and fall on downwardly and rightwardly inclined panel 113 and be deflected rightwardly through right discharge chute 18. If desired, screen 112 may be replaced with a solid metal sheet to deflect all of such crushed material through left discharge chute 16.

Therefore, material to be crushed may be admitted to the crusher apparatus through upper inlet 15, be advanced downwardly between the rotating crush rollers 13 of each cooperative pair, and be thereafter discharged through left and right outlet chutes 16, 18.

From the foregoing, it will be seen that the inventive apparatus 10 includes a housing 11 having an internal conduit 27 arranged to direct the advance of material therealong. The conduit has an inlet opening 15 for admitting material to be crushed and has an outlet opening 41 for discharging crushed material.

The apparatus further includes a plurality of cooperative pairs of rotatable crush rollers 13 which are journalled on the housing 11 and spaced longitudinally along conduit 27. The rollers 13 of each of these pairs have portions arranged within conduit 27 and one spaced operatively from one another transversely of the longitudinal axis of the conduit to crush material passing therebetween. Moreover, the rollers of any one pair arranged closer to the outlet opening 41 are spaced more closely than the rollers of any other pair arranged further from the outlet opening.

The apparatus further includes drive means 14 operatively arranged to rotate at least one roller of each of said pairs in a direction to cause material passing between the rollers of each of said pairs to be advanced toward outlet opening 41. Material passing through opening 41 will fall on screen 112, the coarser material being deflected leftwardly to exit the crusher through chute 16 and the finer material and liquids passing through the screen being deflected rightwardly to exit via chute 18.

While a preferred embodiment of the invention has been shown and described, it will be understood by persons skilled in this art that various changes and modifications may be made without departing from the spirit of the invention which is defined in the following claims.

What is claimed is:

1. Apparatus for crushing material, comprising:

a housing having a conduit for directing an advance of said material therealong, said conduit having an inlet opening for admitting material to be crushed and having an outlet opening for discharging crushed material;

a plurality of cooperative pairs of rotatable crush rollers journalled on said housing and spaced longitudinally along said conduit, the rollers, of each of said pairs having portions arranged within said conduit and spaced operatively from one another transversely of the longitudinal axis of said conduit to crush material passing therebetween, the rollers of any one pair arranged closer to said outlet opening being more closely spaced than the rollers of any other pair arranged further from said outlet opening;

adjustment means operatively arranged between said housing and one of said rollers for enabling adjustment of the operative spacing between the pair including such adjustable roller; said adjustment means including a disc-like cam member rotatably mounted on said housing and provided with a plurality of circumferentially-spaced radially-extending recesses, and a holding member adapted to be received in any of such cam recesses to hold said cam member immovable at a selected angular position, said adjustable roller being journalled at an eccentric position on said roller, whereby material advancing along said conduit may be progressively crushed between the rollers of each successively encountered pair.

2. The apparatus according to claim 1, further comprising:

guide means mounted on said housing and arranged within said conduit for directing material crushed between one of said pairs to the space between the rollers of the next successive pair.

3. The apparatus according to claim 1 wherein said drive means is arranged to rotate both rollers of each of said pairs.

4. The apparatus according to claim 3 wherein said drive means includes endless flexible means operatively engaging each of said rollers, and motor means arranged to move said flexible means.

5. The apparatus according to claim 4 wherein said endless flexible means includes an endless chain.

6. The apparatus according to claim 1, further comprising:

separating means arranged to receive said crushed material and adapted to separate one component part thereof from another component part thereof.

7. The apparatus according to claim 6 wherein said separating means includes a filter screen permeable to said one component part but impermeable to said such other component part.

* * * * *

UNITED STATES PATENT OFFICE

CERTIFICATE OF CORRECTION

Patent No. 3,964,718 Dated June 22, 1976

Inventor(s) Peter A. Balistrieri

It is certified that error appears in the above-identified patent and that said Letters Patent are hereby corrected as shown below:

Claim 1, line 9: the comma after "rollers" should be deleted;

Claim 1, line 29: "roller" should be -- cam member --.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*